US006589064B1

(12) United States Patent
Chen

(10) Patent No.: US 6,589,064 B1
(45) Date of Patent: Jul. 8, 2003

(54) CONNECTOR SECURING DEVICE

(75) Inventor: Yun-Lung Chen, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/172,078

(22) Filed: Jun. 14, 2002

(51) Int. Cl.[7] ..... H01R 13/62
(52) U.S. Cl. ..... 439/304; 439/373; 439/135
(58) Field of Search ..... 439/304, 373, 439/133, 134, 135, 369

(56) References Cited

U.S. PATENT DOCUMENTS 5,011,427 A * 4/1991 Martin ..... 439/373
5,928,023 A * 7/1999 Buckner et al. ..... 439/373
5,934,919 A * 8/1999 Cross et al. ..... 439/136
6,276,952 B1 * 8/2001 Ferranti et al. ..... 439/345
6,309,239 B1 * 10/2001 Johnston ..... 439/373

* cited by examiner

*Primary Examiner*—Hien Vu
(74) *Attorney, Agent, or Firm*—WeiTe Chung

(57) ABSTRACT

A connector securing device includes a rear panel (10) and a housing (20). An opening (14) is defined in the rear panel. A pair of latches (12) extends from a rear face of the rear panel. The housing integrally extends from a front face of the rear panel at the opening, and includes a top wall (21), a bottom wall (23), a sidewall (24) and a pair of end walls (210, 230). The housing defines a pair of entrances (240, 25) at opposite sides thereof, for extension of connectors (40) therethrough. A pair of tabs (211, 231) defining a pair of holes (212, 232) extends forwardly from the end walls. Each connector is received in the housing, and mated with a corresponding connector of an associated electronic apparatus. The connector securing device is then attached to the electronic apparatus via the latches. A padlock (30) is then extended through the holes to lock the connector securing device.

2 Claims, 4 Drawing Sheets

CONNECTOR SECURING DEVICE

BACKGROUND OF THE INVENTION

1. Field of the Invention

The present invention relates to connector securing devices, and more particularly to connector securing devices for preventing connectors from accidentally detaching from complementary connectors.

2. Description of the Related Art

Connectors are frequently used to connect an electronic apparatus such as a personal computer to a peripheral device such as a printer. Typically, the connector is engaged with the electronic apparatus with the aid of a pair of screws positioned on opposite sides of the connector. The screws protect the connector from accidentally detaching from the electronic apparatus. However, when detaching the connector, it is inconvenient to have to unscrew the screws. In addition, a tool is often required for installation and removal of the screws. Furthermore, the screws increase component and production costs. Moreover, the screws do not provide security. Any unauthorized person can detach the connector without permission from the user of the electronic apparatus.

It is desired to provide a simple connector securing device which prevents unauthorized persons from detaching a connector from an electronic device.

SUMMARY OF THE INVENTION

Accordingly, an object of the present invention is to provide a connector securing device which prevents unauthorized detachment of a connector.

Another object of the present invention is to provide a connector securing device which conveniently allows attachment of a connector without the need for screws or tools.

To achieve the above-mentioned objects, a connector securing device in accordance with a preferred embodiment of the present invention comprises a rear panel and a housing. An opening is defined in the rear panel. A pair of latches extends from respective opposite sides of a rear face of the rear panel, for attaching the connector securing device to an associated electronic apparatus. The housing integrally extends from a front face of the rear panel at the opening, and comprises a top wall, a bottom wall, a sidewall, and a pair of end walls. The housing defines a pair of entrances at opposite sides thereof, for extension of a plurality of connectors therethrough. A pair of tabs extends horizontally forwardly from the end walls. A pair of holes is defined in the tabs. Each connector is received in the housing, and mated with a corresponding connector of the electronic apparatus. The connector securing device is then attached to the electronic apparatus via the latches. A padlock is then extended through the holes to lock the connector securing device.

Other objects, advantages and novel features of the present invention will be drawn from the following detailed description of preferred embodiments of the present invention with the attached drawings, in which:

DESCRIPTION OF THE PREFERRED EMBODIMENTS

Figure 1:
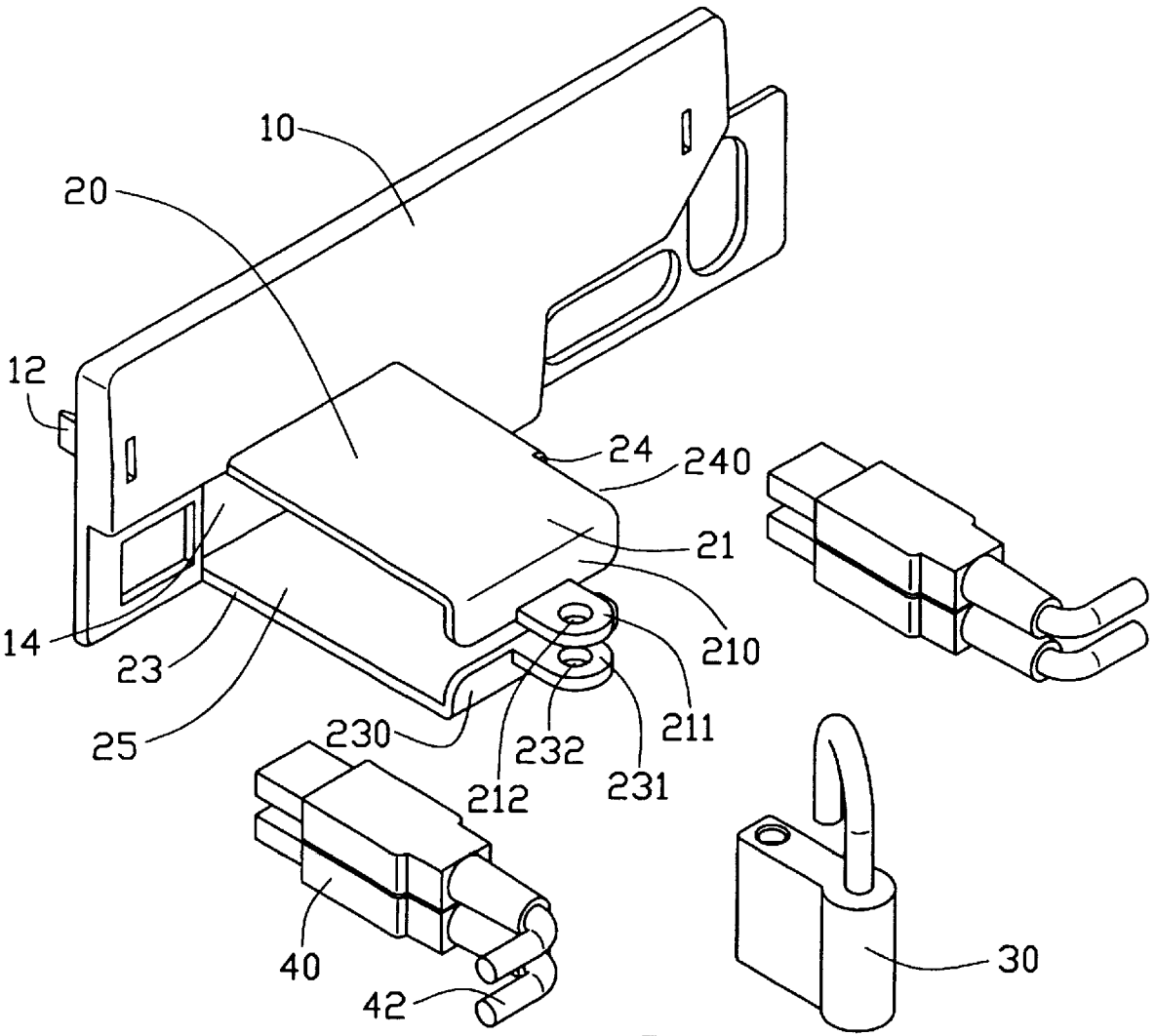
FIG. 1 is an exploded isometric view of a connector securing device in accordance with a preferred embodiment of the present invention, together with two pairs of connectors.

Referring to FIG. 1, a connector securing device in accordance with a preferred embodiment of the present invention comprises a rear panel 10 and a housing 20. The housing 20 is adapted for receiving at least one connector 40. For the purposes of illustrating the preferred embodiment, it will be assumed that the housing is to receive four connectors 40.

The rear panel 10 comprises a pair of latches 12 that extend from respective opposite sides of a rear face thereof. An opening 14 is defined in a lower portion of the rear panel 10. The housing 20 integrally extends from a front face of the rear panel 10 at the opening 14. The housing 20 comprises a top wall 21, a bottom wall 23, and a sidewall 24. The sidewall 24 connects the top wall 21 and the bottom wall 23. The top wall 21, bottom wall 23 and sidewall 24 cooperatively define a receiving space therebetween for receiving the connectors 40. A first entrance 240 is defined in a front portion of the sidewall 24. A second entrance 25 is defined between the top wall 21 and bottom wall 23, opposite from the sidewall 24. A first end wall 210 is bent perpendicularly downwardly from a front portion of the top wall 21. A first tab 211 extends horizontally forwardly from a bottom edge of the first end wall 210. A second end wall 230 is bent perpendicularly upwardly from a front portion of the bottom wall 23. A second tab 231 extends horizontally forwardly from a top edge of the second end wall 230. A pair of coaxial holes 212, 232 is defined in the first and second tabs 211, 231 respectively.

Each connector 40 comprises a main body (not labeled) and a cable 42.

Figure 2:
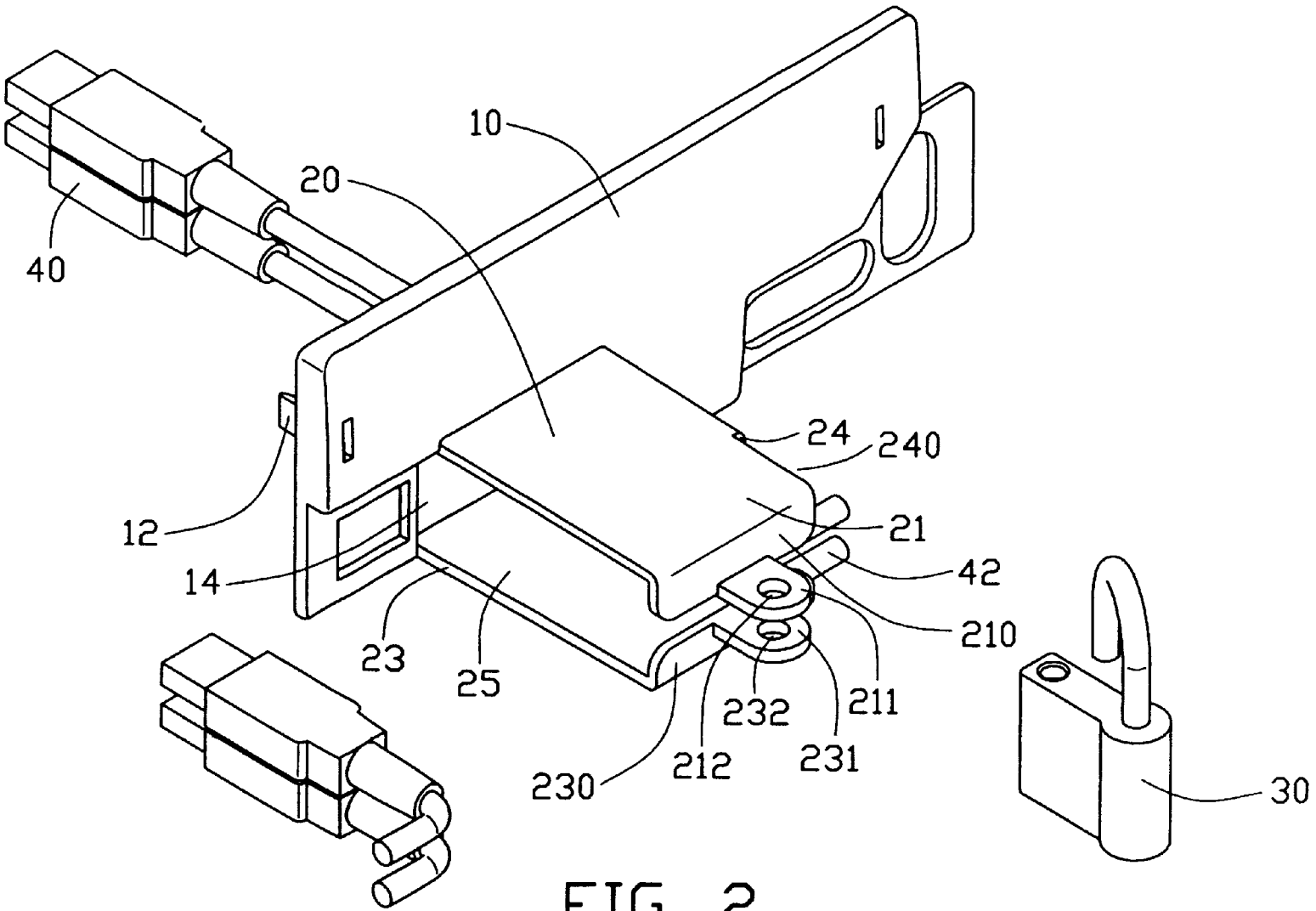
FIG. 2 is a partly assembled view of FIG. 1.
Figure 3:
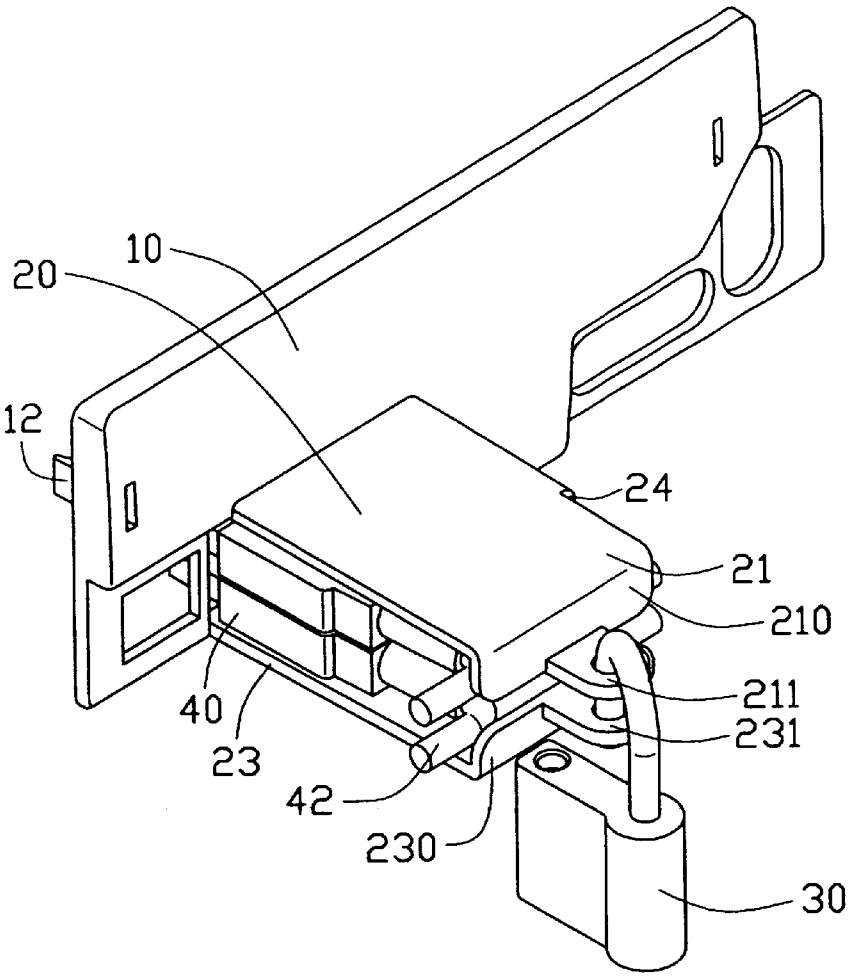
FIG. 3 is a fully assembled view of FIG. 1.

Referring particularly to FIGS. 2 and 3, in assembly, a pair of piggybacked connectors 40 is extended through the first entrance 240 and the opening 14 of the rear panel 10. As seen in FIG. 2, the main bodies of the connectors 40 are behind the rear wall 10, and the cables 42 of the connectors 40 are in the housing 20. Thus ample room is provided in the housing 20 to easily receive another pair of piggybacked connectors 40. The other pair of piggybacked connectors 40 is extended through the second entrance 25 and the opening 14. The four connectors 40 are then mated with corresponding complementary connectors (not shown) of an associated electronic apparatus (not shown). The connector securing device is then attached to the electronic apparatus via the latches 12 of the rear panel 10. A padlock 30 is then extended through the first and second holes 212, 232 to lock the connector securing device.

Figure 4:
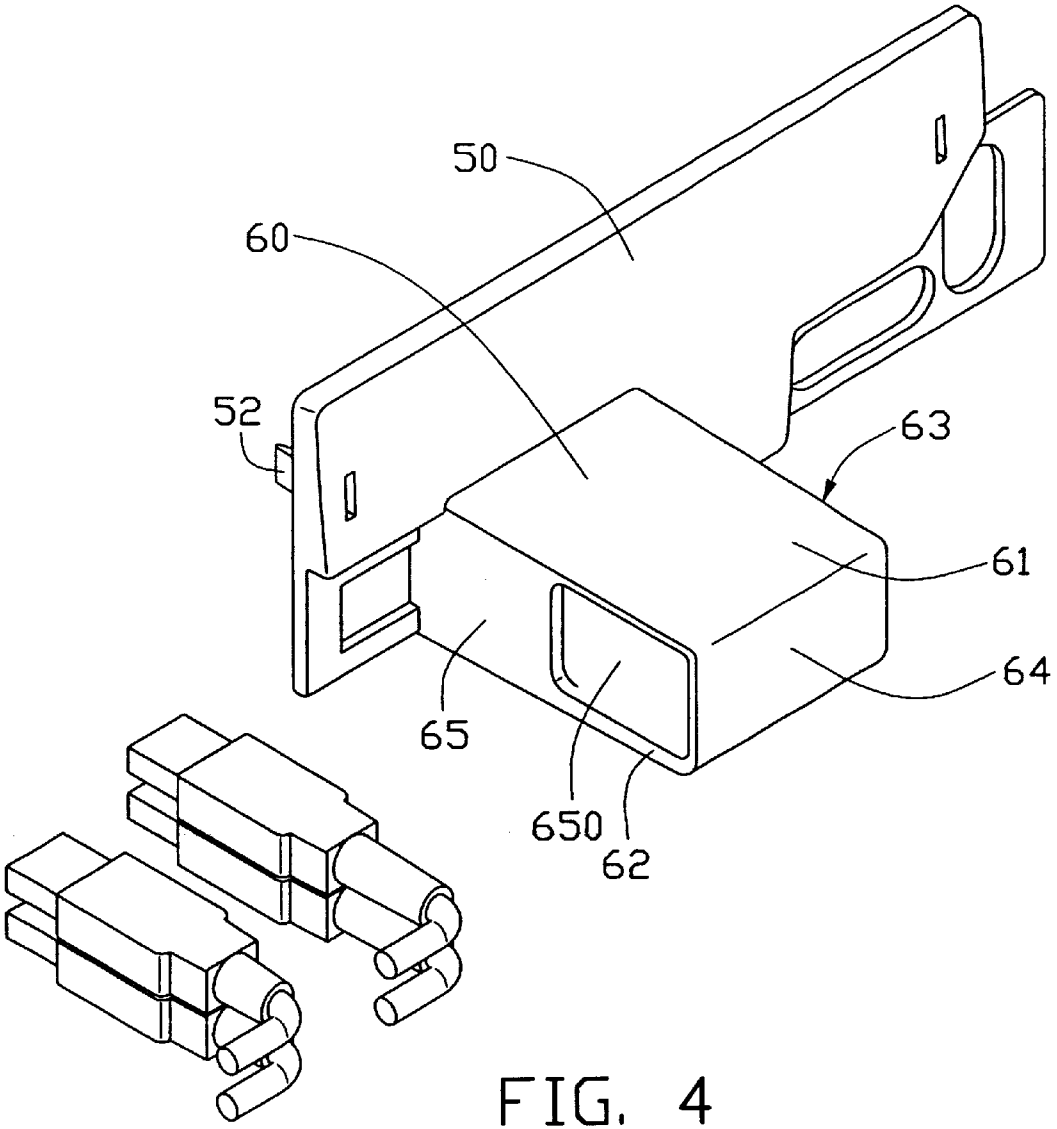
FIG. 4 is an exploded isometric view of a connector securing device in accordance with an alternative embodiment of the present invention, together with two pairs of connectors.

FIG. 4 shows a connector securing device in accordance with an alternative embodiment of the present invention. The connector securing device comprises a rear panel 50 and a housing 60. The housing 60 integrally extends from a front face of the rear panel 50 at an opening (not shown) defined in the rear panel 50. The housing 60 comprising a top wall 61, a bottom wall 62, a pair of opposing sidewalls 63, 65, and an end wall 64; all of which cooperatively define a receiving space is defined a receiving space therebetween for receiving at least one connector (not labeled). An entrance 650 is defined in a front portion of the sidewall 63.

A pair of latches 52 extends from respective opposite sides of a rear face of the rear panel 50, for engaging with an associated electronic apparatus (not shown). Assembly of the connector securing device is similar to assembly of the connector securing device of the preferred embodiment. Reference is made to the above detailed description of assembly of the connector securing device of the preferred embodiment, with due alteration of details.

While the present invention has been illustrated by the description of embodiments thereof, and while the embodiments have been described in considerable detail, it is not intended to restrict or in any way limit the scope of the appended claims to such detail. Additional advantages and modifications will readily appear to those skilled in the art. Therefore, the present invention is not limited to the specific details and illustrative examples shown and described.

What is claimed is:

1. A connector assembly comprising:

a panel defining an opening therethrough in a front-to-back direction, said panel being adapted to be assembled to or part of an electronic device;

an electrical connector including a main body with a cable extending from a rear portion thereof and a mating portion extending forwardly from a front portion thereof, said mating portion extending forwardly through said opening for mating with a complementary connector of said electronic device; and a housing extending rearwardly from an outward face of the panel; wherein said housing is arranged in a normal situation, prohibiting said connector from moving rearwardly so as to assure reliable mating between the connector and the complementary connector; wherein said at least a portion of said housing is integrally formed with the panel; wherein a pair of latching means extends from opposite sides of the panel for fixing the panel to said electronic device; wherein the housing comprises a top wall, a bottom wall and a sidewall connecting the top wall and bottom wall, a first entrance is defined in a front portion of the sidewall, and a second entrance is defined between the top wall and bottom wall opposite from the sidewall; wherein a first end wall is arranged downwardly from the top wall, a second end wall is arranged upwardly from the bottom wall, a first tab extends from the first end wall, a second tab extends from the second end wall, and a hole is defined in each of the first and second tabs for a extension of a lock therethrough, wherein the first and second entrances include spaces for allowing the cable to extend therethrough and in parallel with the end walls.

2. The assembly as claimed in claim 1, wherein at least a portion of said housing is immoveable relative to panel.

* * * * *